United States Patent [19]

Klinkhardt

[11] Patent Number: 5,022,625

[45] Date of Patent: Jun. 11, 1991

[54] SELECTIVELY-REMOVABLE, WALL-MOUNTABLE CONTAINER

[76] Inventor: Lothar Klinkhardt, 4998 Martindale St. NE., Prior Lake, Minn. 55372

[21] Appl. No.: 467,554

[22] Filed: Jan. 19, 1990

[51] Int. Cl.[5] ..... A47K 5/00

[52] U.S. Cl. ..... 248/309.2; 248/311.2

[58] Field of Search ..... 248/682, 683, 311.2, 248/309.2; 411/404, 913, 508; 215/100 R

[56] References Cited

U.S. PATENT DOCUMENTS

| | | | |
|---|---|---|---|
| 952,495 | 3/1910 | Austin | 248/683 |
| 2,586,626 | 2/1952 | Dunn | 248/309.2 |
| 2,785,453 | 3/1957 | Wentz | 411/44 X |
| 3,178,061 | 4/1965 | Giacalone et al. | 248/311.2 X |
| 3,289,990 | 12/1966 | Grantham | 248/683 X |
| 4,309,014 | 1/1982 | Blaszkowski | 248/309.2 X |
| 4,640,895 | 2/1987 | Davis | 248/311.2 X |
| 4,825,590 | 5/1989 | Cullinane | 248/311.2 X |

*Primary Examiner*—David L. Talbott

*Attorney, Agent, or Firm*—Milton S. Gerstein

[57] ABSTRACT

A novel storage container is provided that is capable of continual reuse, which novel container may be easily and readily stored on substantially any vertical surface in a home, office, business, and the like. The novel container has a rearwardly-facing concave-shaped cutout or depression formed in the rear surface thereof, which cutout or depression is used for receiving therein, in a force-fit manner, an enlarged sphere or convex-shaped knob secured to a vertical surface, such as a wall or door, by which the container may be removably mounted to such vertical surface, for subsequent removal therefrom when it is needed to dispense the contents of the container.

8 Claims, 1 Drawing Sheet

SELECTIVELY-REMOVABLE, WALL-MOUNTABLE CONTAINER

BACKGROUND OF THE INVENTION

The present invention is directed to a container for storing liquids, solids, separable items, and the like, which container is also used in dispensing the contents thereof. The container of the invention may be used for storing and dispensing shampoo, hair conditioner, liquid cleaning agents, medicinal pills, and a host of other contents, where such container stores the contents when not needed, and which container is used for dispensing the contents when such contents are needed for use. Conventional storage and dispensing containers, whether made of glass or plastics, are generally stored upright on a shelf or floor, with the bottom surface of the container supporting it on the shelf, or the like. Such conventional containers, therefore, require available horizontal space or area for their storage, which often times is not available, or available only to a limited degree. Thus, available space, whether in a home, office, business, etc., must be judiciously apportioned for an optimum allocation of containers requiring storage. In addition, it often occurs that there is no horizontal shelf or support available for supporting the container at a location where it would be most convenient. The present invention solves these problems of limited or no horizontal support surface by providing a container, capable of multifarious uses, sizes, and shapes, which utilizes the vertical space available and provided by walls, shelf-doors, closet doors, and the like, thereby completely obviating the need or necessity of horizontal supporting surfaces for storing containers, while at the same time allowing for facile and quick use as well easy return of the container to its storage-location.

SUMMARY OF THE INVENTION

It is, therefore, the primary objective of the present invention to provide a novel storage container that is capable of continual reuse, which novel container may be easily and readily stored on substantially any vertical surface in a home, office, business, and the like.

It is another objective of the present invention to provide such a novel container which, in the preferred embodiment, has a rearwardly-facing concave-shaped cutout or depression formed in the rear surface thereof, which cutout or depression is used for receiving therein, in a force-fit manner, an enlarged sphere or convex-shaped knob secured to a vertical surface, such as a wall or door, by which the container may be removably mounted to such vertical surface, for subsequent removal therefrom when it is needed to dispense the contents of the container.

BRIEF DESCRIPTION OF THE DRAWINGS

The invention will be more readily understood with reference to the accompanying drawing, wherein.

DETAILED DESCRIPTION OF THE INVENTION

Figure 1:
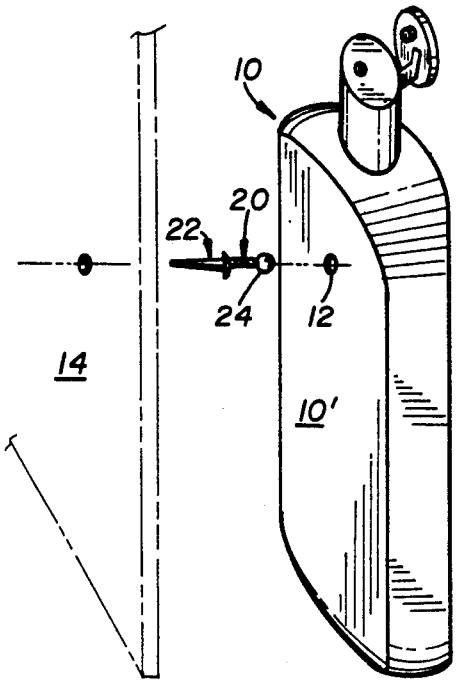
FIG. 1 is a perspective view showing the novel container of the invention having a rearwardly-facing indentation or concave-shaped cutout, with a first type of mounting means being used for removably securing the container to a vertical surface.

Referring now to the drawings in greater detail, each of the figures shows a container 10 that may be used for storing and dispensing liquids, solids, and the like, such as shampoo, liquid detergent, powders, pills and other medicines, etc. The container may be made of glass or plastics. The container 10 may take on any shape, size and form, but, according to the invention, is provided with a concave-shaped recess, depression or cutout 12 on one surface thereof, preferably the rear surface 10' of the container 10, which depression or cutout is provided in an upper portion, and approximately in a center or middle section thereof, of the rear surface 10', with there being only one such depression 12 provided, the rear surface 10' being a continuous uninterrupted surface area in all directions from the concaved-shaped recess as shown in the drawings. The purpose of the cutout or depression 12' is to allow for the container 10 to be removably mounted to a vertical surface 14, such as a cabinet door, wall surface, and the like. The removable mounting of the container 10 is achieved by mounting structure that defines a spherical or enlarged knob-like projection projecting outwardly from the mounting structure, and, therefore, away from the vertical support surface 14. Various mounting structures may be used. In FIG. 1, there is shown a screw 20 and expandable mounting sleeve 22 for fixed securement in the vertical surface 14, which is achieved in a well-known and conventional manner. The screw 20, however, is provided with an enlarged head or knob 24 that is removably receivable in the concave-shaped cutout 12 of the container 10. In the preferred embodiment, the enlarged head or knob 24 is a substantially convex-shaped solid surface for mating and force-fit engagement with the concave-shaped cutout 12 of the container 10. The head 24 is also provided with one or more slots for accommodating a screw driver for rotating the screw during the mounting thereof to the vertical surface 14. When the container 10 is made of plastic, which is substantially inherently resilient, the knob or head 24 need not be resilient or flexible, for the joinder with the concave-shaped cutout 14 will be achieved by the giving or flexing of the container proper during the insertion of the knob 24 into the opening 14. When the container is made glass, then the knob 24 will be made of flexible, resilient material, such as a soft synthetic rubber or thermoplastic resin material. It is to be understood that the types of material used for the knob 24 would be apparent to one of ordinary skill in the art, when it is desired to provide a resilient knob 24 for use with a glass container 10. It is, of course, possible to use a resilient knob 24 for plastic and flexible containers 10. The knob 24 is preferably convex-shaped to mate with the concave-shaped cutout 14 of the container, but it is to be understood that other shapes and configurations are possible to achieve the force-fit type of joint-connection. It is preferable that the fit be tight enough so as to substantially prevent rotation of the container about the connection with the mounting structure, although it is within the scope and purview of the invention to allow for such relative movement. It is also within the scope and purview of the invention to reverse the connections, and provide the knob or convex-shaped protuberance on the rear surface of the container, so that it projects rearwardly therefrom, and to form the head of the screw with a concave-shaped cutout or opening for receiving the knob of the container. Of course, the head of the screw will still be provided with slots for accommodating a screw driver.

Figure 2:
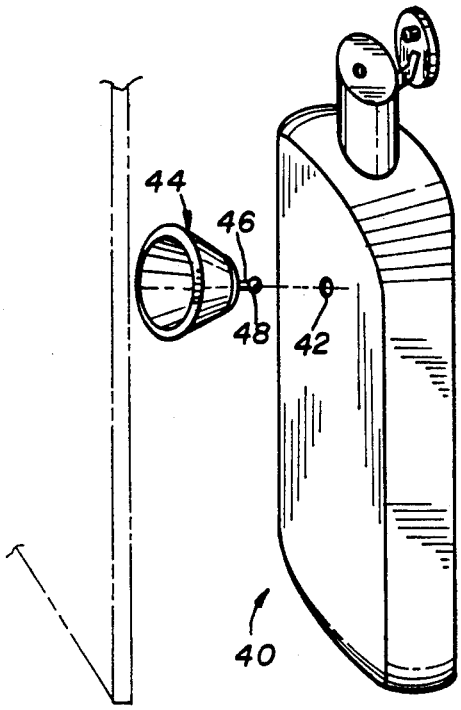
FIG. 2 is a perspective view showing the novel container of the invention having a rearwardly-facing indentation or concave-shaped cutout, with a second type of mounting means being used for removably securing the container to a vertical surface.

In FIG. 2, there is shown a second embodiment of the vertical attaching structure for removable securing a container 40 to a vertical surface. The container 40 also has a concave-shaped depression or cutout 42, which is removably and selectively supportable by a vertical wall or door surface via attaching structure 44. The attaching structure 44 in this embodiment includes a suction cup made of rubber or other suitable material, which defines a rearward concave shape defining the suctioning portion thereof, and an outward-facing convex surface from which integrally projects a rod or shaft 46, at the exterior end of which is formed a convex-shaped or bulbous-shaped knob or surface 48 for selective and removable cooperation with the cutout 42, as described above with regards to the embodiment of FIG. 1. The joint-coupling is achieved by force-fit therebetween, as described above. The suction cup allows for easy and quick removable of the supporting structure for placement on another vertical support surface.

Figure 3:
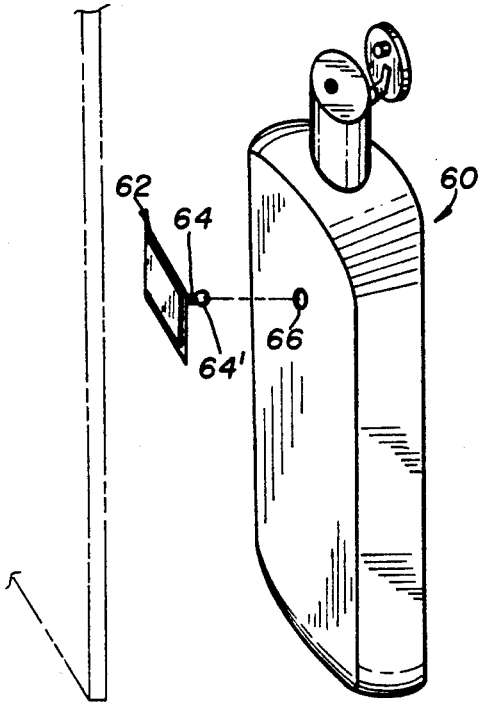
FIG. 3 is a perspective view showing the novel container of the invention having a rearwardly-facing indentation or concave-shaped cutout, with a third type of mounting means being used for removably securing the container to a vertical surface.

FIG. 3 shows a third embodiment of the invention for removably supporting a container 60 on a vertical surface. In this embodiment, the supporting structure includes an adhesive-backed mounting plate 62 which, after removing an outer protective cover layer, adhesive is exposed for securing the plate to a vertical wall or door surface, in a well-known manner. Projecting from the front surface of the plate 62 is a rod or shaft 64 at the exterior end of which is formed a bulbous or convex-shaped knob 64 for cooperating with the concave cutout 66 of the container 60, in a force-fit manner, as described above.

When the container 10, 40 or 60 is made of glass, then the knob or convex-surface mating with the cutout of the container is made of flexible material, such as relatively-soft thermoplastic resin material. When the container is made of plastic, then the convex surface or knob may be made of relatively hard plastic or soft plastic, it being understood, that one of ordinary skill in the art will be able to choose the requisite material to provide the force-fit joint between the elements. It is also preferable that the force-fit joint allow little, or no, relative movement between the cooperating elements, though the possibility of such relative movement may be provided. As in the first embodiment of FIG. 1, the male and female elements may be reversed so that the female element or cutout or depression is provided at the exterior end of the respective rod or shaft, while the male element, or convex surface or knob, projects from a surface of the respective container.

While specific embodiments of the invention have been shown and described, it is to be understood that numerous changes and modifications may be made therein without departing from the scope, spirit and intent of the invention as set forth in the appended claims.

What I claim is:

1. In a container for storing contents therein, and for dispensing the contents therefrom, said container comprising a forward-facing surface, a rearward-facing surface, a first side-facing surface, a second side-facing surface, a lower surface, and a dispensing mouth, the improvement comprising:

one of said surfaces of said container comprising a first cooperating means for permitting the removable mounting of said container to a vertical wall surface; and a vertical surface to which said container is mounted;

mounting means for securement to said vertical support surface for removably mounting said container to said vertical surface, said mounting means comprising means for attachment to said vertical surface, and second cooperating means capable of being removably coupled with said first cooperating means, whereby said container may be removably supported by said vertical surface;

one of said first and second cooperating means comprising a female member, and the other of said first and second cooperating means comprising a male member for removable insertion into said female member;

said female member being a substantially concave-shaped recessed cutout, and said male member being a substantially convex-shaped surface member; said concave-shaped recessed cutout being provided on an upper portion, and approximately in a center section of said one surface, said male and female members being force-fitted together, said mounting means supporting said container in the air, said lower surface of said container being suspended freely in the air and spaced above a horizontal support surface, such that said convex-shaped surface member is the support for said container.

2. The improvement according to claim 1, wherein said means for attachment to a vertical surface of said mounting means comprises a screw, said screw having a head, said head having said convex-shaped surface member projecting outwardly therefrom, said head also having at least one slot for receiving a screw driver for the rotation thereof.

3. The improvement according to claim 1, wherein said means for attachment to a vertical surface of said mounting means comprises a suction cup, and a rod projecting from the exterior surface of said suction cup and defining an exterior end, said second cooperating means being provided at said exterior end of said rod.

4. The improvement of claim 1, wherein said means for attachment to a vertical surface of said mounting means comprises an adhesive attachment means, and a rod projecting from the exterior surface of said adhesive attaching means and defining an exterior end, said second cooperating means being provided at said exterior end of said rod.

5. The improvement according to claim 1, wherein at least one of said container and said second cooperating means are made of resilient, flexible material to allow for said force-fit coupling therebetween.

6. The improvement according to claim 5, wherein said container is made of glass and said second cooperating means is made of resilient, flexible material.

7. The improvement according to claim 1, wherein said one surface is said rear surface.

8. The improvement according to claim 7, wherein said rear surface comprises a continuously uninterrupted surface area in all directions from said concaved-shaped recess.

* * * * *